US007517041B2

(12) United States Patent
Palmer et al.

(10) Patent No.: US 7,517,041 B2
(45) Date of Patent: Apr. 14, 2009

(54) PRINTING AND DETECTING A FIXER PATTERN ON A MEDIUM

(76) Inventors: Donald J Palmer, 2497 E. Brigantine Ct., Eagle, ID (US) 83616; Jordi Arnabat Benedicto, C/Horts, 13 C 4rt 2a L'Arbo, Tarragona (ES) 43720; Oscar Martinez, Pintor Serrasanta 16, 7-4 Castelldefels, BCN 08860 (ES); Javier Lagares, Avda. Graells, 501 08190 Sant Cugat del Valles, Barcelona (ES)

( * ) Notice: Subject to any disclaimer, the term of this patent is extended or adjusted under 35 U.S.C. 154(b) by 566 days.

(21) Appl. No.: 10/717,953

(22) Filed: Nov. 19, 2003

(65) Prior Publication Data

US 2005/0106365 A1 May 19, 2005

(51) Int. Cl.
*B41J 2/205* (2006.01)

(52) U.S. Cl. ..... 347/15; 347/96

(58) Field of Classification Search ..... 347/15, 347/43, 96, 98, 16, 102, 19
See application file for complete search history.

(56) References Cited

U.S. PATENT DOCUMENTS 5,460,646 A 10/1995 Lazzouni et al.
5,652,412 A 7/1997 Lazzouni et al.
5,661,506 A 8/1997 Lazzouni et al.
5,980,016 A 11/1999 Nelson et al.
6,132,024 A 10/2000 Nelson et al.
6,134,025 A * 10/2000 Takeuchi et al. ..... 358/1.2
6,158,834 A * 12/2000 Kato et al. ..... 347/9
6,164,749 A 12/2000 Williams
6,378,976 B1 * 4/2002 Byers et al. ..... 347/19
6,474,778 B1 * 11/2002 Koitabashi et al. ..... 347/43
6,523,920 B2 2/2003 Wade et al.
6,572,213 B2 6/2003 Valero
6,582,052 B2 6/2003 Sarmast et al.

* cited by examiner

*Primary Examiner*—Lamson D. Nguyen

(57) ABSTRACT

A method for printing a coordinate pattern on a medium includes assigning a pattern to the medium. The pattern is formed on the medium with fixer. A method of calculating a position of an object in relation to the medium using the pattern is disclosed. A predetermined wavelength of electromagnetic radiation is projected onto the pattern and a presence of absence of emittance from the fixer of the pattern is detected. A medium including a substrate having a coordinate pattern overlying at least one side of the substrate is further disclosed. The coordinate pattern includes a means for fluorescing when subjected to a predetermined wavelength of electromagnetic radiation. In another embodiment, a system for forming a substantially invisible coordinate pattern on a medium is disclosed.

21 Claims, 5 Drawing Sheets

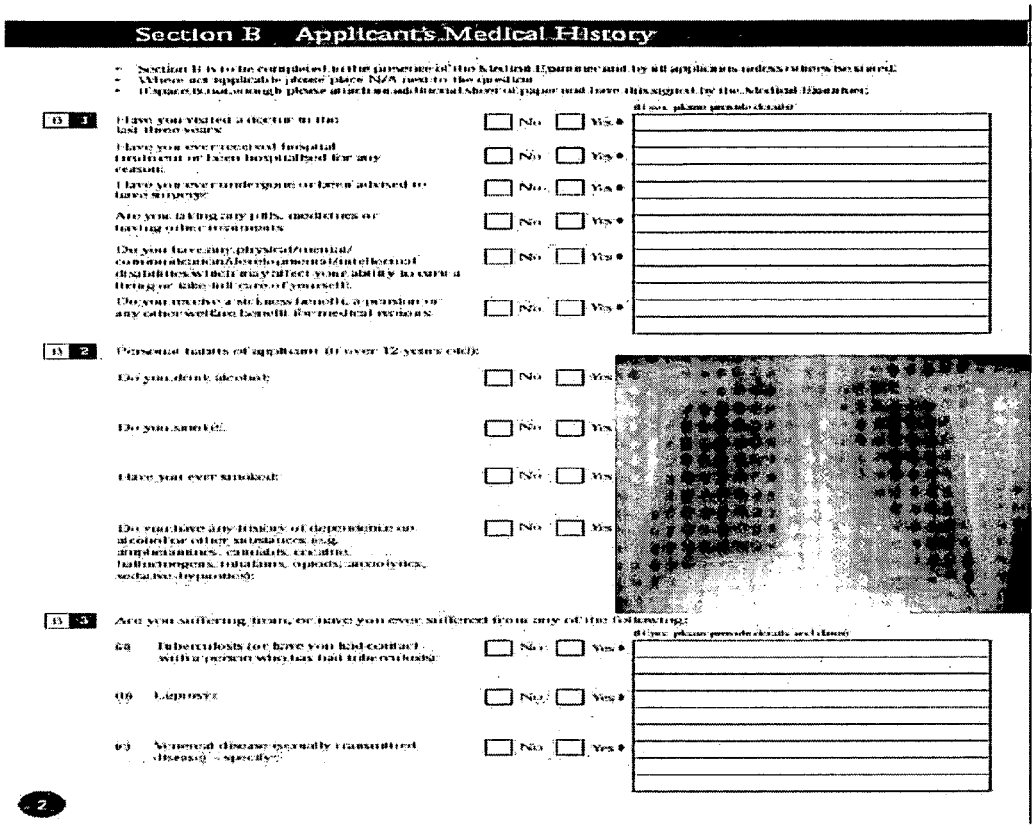

Section B Applicant's Medical History

- Section B is to be completed in the presence of the Medical Examiner and by all applicants unless others be stated.
- Where not applicable please place N/A next to the question.
- If space is not enough please attach an additional sheet of paper and have this signed by the Medical Examiner.

| | | | | If yes, please provide details |
|---|---|---|---|---|
| B 1 | Have you visited a doctor in the last three years? | No | Yes | |
| | Have you ever received hospital treatment or been hospitalized for any reason? | No | Yes | |
| | Have you ever undergone or been advised to have surgery? | No | Yes | |
| | Are you taking any pills, medicines or having other treatments | No | Yes | |
| | Do you have any physical/mental/communication/development/intellectual disabilities which may affect your ability to earn a living or take full care of yourself? | No | Yes | |
| | Do you receive a sickness benefit, a pension or any other welfare benefit for medical reasons? | No | Yes | |

| | | | | |
|---|---|---|---|---|
| B 2 | Personal habits of applicant (if over 12 years old): | | | |
| | Do you drink alcohol? | No | Yes | |
| | Do you smoke? | No | Yes | |
| | Have you ever smoked? | No | Yes | |
| | Do you have any history of dependence on alcohol or other substances (e.g. amphetamines, cannabis, cocaine, hallucinogens, inhalants, opioids, anxiolytics, sedatives, hypnotics)? | No | Yes | |

| | | | | If yes, please provide details as follows |
|---|---|---|---|---|
| B 3 | Are you suffering from, or have you ever suffered from any of the following: | | | |
| | (a) Tuberculosis (or have you had contact with a person who has had tuberculosis) | No | Yes | |
| | (b) Leprosy? | No | Yes | |
| | (c) Venereal disease (sexually transmitted disease) – specify? | No | Yes | |

2

FIG. 4

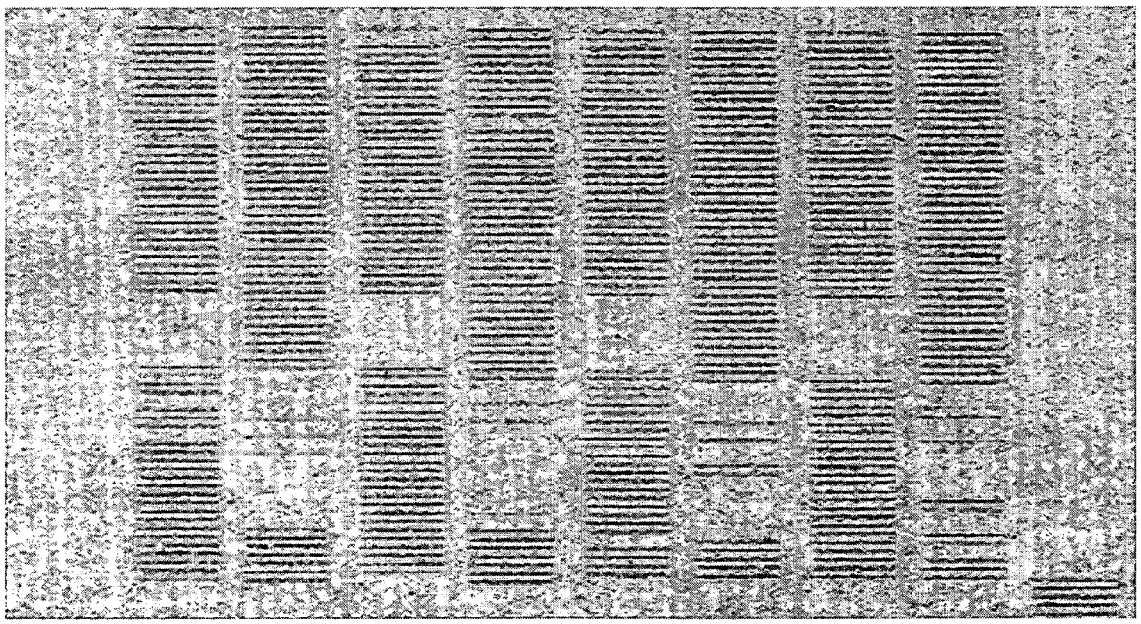

FIG. 5

PRINTING AND DETECTING A FIXER PATTERN ON A MEDIUM

FIELD OF THE INVENTION

The present invention relates generally to image-forming technology methods and devices, and more particularly to methods of printing and detecting a coordinate pattern on a medium.

BACKGROUND OF THE INVENTION

Electronic devices that sense and store manual writing are known in the art. For instance, back-lit liquid crystal display capture terminals are able to sense and store manually written signals using a touch sensitive screen and have utility in capturing electronic signatures, such as for recording credit card signatures. Further, computers including personal digital assistants (PDA) and other palm-sized computers use a stylus and a touch screen in combination with a handwriting recognition program to record the handwriting.

However, the use of such touch sensitive screens or palm sized computers is often economically unaffordable in many applications since the devices that include input screens may be expensive. For example, in a hospital where each doctor treats several patients and prepare notes or reports about patient symptoms and progress, having to provide each doctor with a laptop or a PDA would be expensive and provide a non-flexible and non-user friendly interface for gathering data. In some instances, a two-dimensional device that generates and electronically stores handwritten data, text, sketches, and drawings is needed. Known two-dimensional digital devices include an output, such as a pen, that writes on a medium (i.e., paper) and an input, such as a digital camera, that captures a digital image of the data left on the medium by the output.

The location of the digital camera and the pen in relation to the medium may be determined by calculating a location of the two-dimensional device in relation to the medium using a coordinate system printed on the medium. For instance, a dot-pattern, such as a 6×6 matrix of black dots, may be printed on the medium using a traditional CMYK color space or a K color space wherein (C) is cyan, (M) is magenta, (Y) is yellow, and (K) is black in the visible region of the spectrum, i.e., about 400-700 nm. In the visible region of the spectrum, the colors are visible to the naked eye and are visible colorants. As the pen of the two-dimensional device is placed on the medium, the camera moves over the visible dot-pattern printed on the medium, extracts the visible dot-pattern, and decodes the position of the two-dimensional device in relation to the medium. The position and movement of the two-dimensional device on the medium can, thus, be determined and electronically stored.

However, since the digital camera is scanning a visible dot-pattern printed on the media, the presence of the visible dot-pattern may distort the readability, the aesthetic appearance, the overall image quality and flexibility in the document design layout, thus, decreasing the value of the information contained within the printed document. Further, if the medium is a pre-printed form having existing text, lines or boxes of ink, the visible, existing ink on the medium may hinder the effectiveness of the digital camera from recording the position of the two-dimensional device on the medium.

BRIEF SUMMARY OF THE INVENTION

The embodiments of the invention include methods and devices used to produce a coordinate pattern on a medium, wherein the coordinate pattern is substantially invisible to the naked eye. The invisible printed coordinate pattern allows a user of the printed coordinate pattern to determine a position of an object on the medium.

In one embodiment, a method for printing a substantially, invisible coordinate pattern on a medium is described. The method includes assigning a pattern to the medium, wherein the pattern defines coordinates of the medium. The method further includes applying a fixer to the medium in the pattern.

In another embodiment, a method for calculating a position of an object in relation to a medium includes applying a coordinate pattern to a medium, wherein the coordinate pattern comprises a fixer capable of fluorescing when subjected to a predetermined wavelength of electromagnetic radiation. The predetermined wavelength is projected onto the pattern and a presence or an absence of emittance from the fixer in the coordinate pattern on the medium excited by the wavelength is detected. In response to the presence or the absence of the emittance, a position of the object is calculated in relation to the medium.

In an additional embodiment, a medium comprising a substrate having a coordinate pattern applied to at least one side of the substrate is described. The coordinate pattern comprises a means for fluorescing When subjected to a predetermined wavelength of electromagnetic radiation.

In yet another embodiment, a system for forming a substantially invisible coordinate pattern on a medium includes an image-forming device. The image-forming device includes a first pen for applying visible ink to a medium and a second pen for applying a fixer to the medium, wherein the fixer is applied in a coordinate pattern. The system further includes a medium comprising the coordinate pattern.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

FIG. 4 illustrates a view of a document produced using an embodiment of the image-forming system of the present invention;

FIG. 5 depicts one possible embodiment of an encoding pattern printed with fixer and the image-forming system of FIG. 1.

DETAILED DESCRIPTION OF THE INVENTION

Figure 1:
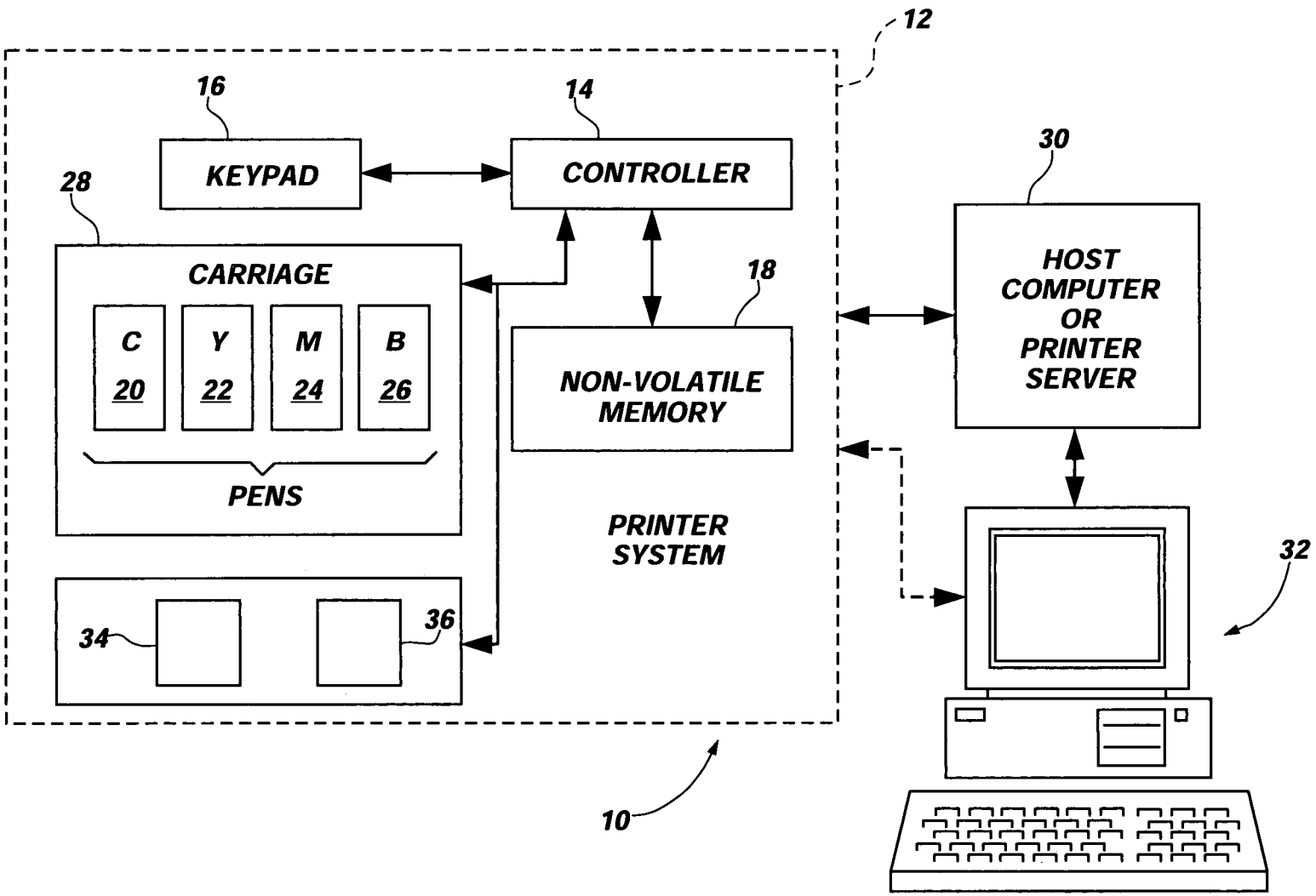
FIG. 1 is a block diagram of one embodiment of an image-forming system of the present invention.

Referring now to FIG. 1, one embodiment of an image-forming system of the present invention is shown generally at 10. The image-forming system 10 comprises an image-forming device 12 such as, for example, a thermal-inkjet desktop printer, a large-format plotter, a piezo-electric desktop printer, a large-form plotter, a laser printer, any inkjet printer, any laserjet printer, or any other image-forming device known by those of ordinary skill in the art. The image-forming device 12 may include a controller 14 that is operatively coupled to control console keypad 16 and a non-volatile memory 18. The image-forming system 10 further includes four color ink-jet pens or cartridges 20, 22, 24 and 26, which can be mounted, for example, on a reciprocable carriage 28. Those of ordinary skill in the art will understand that the reciprocal movement of the carriage 28 and firing of the pens 20, 22, 24, and 26 are controlled by the controller 14 to place visible ink on a print medium (not shown). The print medium is advanced orthogonally past the carriage 28 that can be controlled, for example, by a paper feed motor and opposing rollers (not shown).

The image-forming system 10 may be instructed by a host computer or server 30, to which a personal computer (PC) or terminal 32 is connected to print four-color images or a single color image that may include, for example, text. In another exemplary embodiment, the PC or terminal 32 may be directly connected to the image-forming device 12. The control and monitoring of the image-forming device 12 can be made to, for example, a logic server, driver or any other mechanism known in the art that is capable of commanding the image-forming device 12 to print and monitor its print status.

The non-volatile memory 18 may be an integral part of the controller 14 and can comprise, for example, a programmed microprocessor, or may be connected thereto over a data and address bus as illustrated in FIG. 1. Other image-forming elements (not illustrated) that may be controlled by the non-volatile memory 18 include known image-forming elements, such as driver motors (e.g., servo motors), that control the advancement of the medium past the carriage mounting the four color pens 20, 22, 24 and 26 and that control the reciprocation of the pen-mounted carriage. The pens 20, 22, 24 and 26 may also be referred to herein by their primary, or printing process, ink colors including cyan (C), yellow (Y), magenta (M) and black (K). It will further be appreciated that other colors (e.g., red, green, blue and black) that are capable of achieving the full visible color spectrum can be used to achieve high-quality printing results. In another embodiment, the image-forming device 12 may not be a color image-forming device, but may be an image-forming device that prints in black ink.

The image-forming system 10 described herein further includes a means for fluorescing that is applied to a print medium (not shown). The means for fluorescing includes "fixers" that may be used alone or in combination with the visible, pigmented inks. Fixers, as the name implies, generally refers to materials that may be applied beneath a colored ink drop (e.g., pre-coats) and materials that may be applied over a colored ink drop (e.g., post-coats). The fixers are often liquid and as the name implies are used to "fix" ink on a print medium. The fixers may be used to improve the adhesion of the ink drops onto the print medium, the dry rub, water resistance, or highlighter resistance. Further, the fixers may be used to control the dry time of ink drops and/or the light fastness of ink drops.

As used herein, the term "fixer" will be used to refer to compounds that are not visible (i.e., substantially invisible) to the naked eye under regular illumination. Thus, "fixer" refers to compounds that absorb radiation at a wavelength of about 700 nm (infrared) and below, and that absorb radiation at a wavelength of about 400 nm and above (ultraviolet), but that are not in the visible spectrum. The fixers described herein are characterized by having fluorescence, phosphorescence, or combinations thereof in the infrared, visible and ultraviolet spectrum, but do not absorb radiation in the visible spectrum and, thus, are not visible to the naked eye.

Since the means for fluorescing or the fixer is essentially transparent and, thus, not visible to the naked eye under daylight or indoor illumination, the fixer may include a small amount of an essentially visually colorless infrared or ultraviolet additive luminescent marker (AM) that provides the fixer with fluorescence. The marker may be a colorless or transparent vehicle that may include added components that are capable of producing infrared or ultraviolet adsorption properties in the infrared or ultraviolet region of the electromagnetic spectrum. The luminescent marker (AM) may be excited by a first wavelength emitted from a source of electromagnetic radiation (i.e., in the infrared or ultraviolet range of the electromagnetic spectrum) and may emit electromagnetic radiation of a second wavelength (i.e., fluorescence). The first wavelength is pre-determined to be in the range of infrared (IR) or ultraviolet (UV) radiation. The luminescent marker is substantially colorless in the visible region of the electromagnetic spectrum. The luminescent marker adsorbs infrared or ultraviolet radiation of a first wavelength and cause excitation of the luminescent marker, thus effectuating the infrared or ultraviolet wavelengths to emit radiation in the visible domain of a second wavelength and result in the process or phenomenon of fluorescence.

Although the luminescent marker will be excited and emit certain wavelengths, it will be apparent that in terms of the first and second wavelengths, a single wavelength is seldom attained. Thus, when using filters, the wavelength ranges, bands or varying widths are usually encountered. The term "luminescence" as used herein includes fluorescence (emission from a singlet excited state), phosphorescence (emission from a triplet excited state) and may be referred to as emittance.

The concentration of the luminescent marker in the fixer will be sufficient such that upon stimulation or excitation by a source of electromagnetic radiation operating at a first wavelength range, electromagnetic radiation of a second wavelength range will be emitted by the luminescent marker and be detectable by a suitable sensor. However, the concentration of the luminescent marker may be below the amount that would lead to self-quenching and, thus, reduce the intensity of the second wavelength emitted. A person of ordinary skill in the art may determine the appropriate concentration range for a given luminescent marker in a specific liquid environment.

The fluorescent marker may be a UV-adsorbing fluorescent material, such as an optical brightener, which under UV illumination glows with visible light (usually blue). For example, Blankophor P167 (Bayer Corp.) may be used and allows detection of the printed pattern upon illumination with UV light.

Similarly, a small amount of an IR-emitting chromophore may be employed to print the pattern on the medium. For example, Tinolux BBS (Ciba Specialty Chemicals) may be used and allows detection of the pattern under red or IR light illumination. Tinolux BBS is an aluminum phthalocyanine. Other metal phthalocyanines are also known to luminesce and are, thus, encompassed by the present invention. Such other metal phthalocyanines which may be used in the practice of the present invention include, without limitation, zinc, cadmium, tin, magnesium, europium, or any combinations thereof.

In one exemplary embodiment, the concentration range of the UV/optical brightener is from about 0.001 to 3% by weight. The lower value will be determined by detectability and is dependant upon use of a non-optically brightened medium, the penetration of the luminescent marker into the medium, and the sensitivity of the detection system. The upper value will be determined by pen reliability/operability and self-quenching by some chromophores.

The IR markers may have some red adsorption, which makes the IR markers appear cyan at high concentrations. Accordingly, the lower value or concentration is similar to the lower concentration described herein with regard to the UV/optical brightener, about 0.001% by weight, depending on how well the marker fluoresces and how much it penetrates into a porous/scattering medium (reducing signal). The upper value of the concentration is dependent upon how much color is desired and pen operability. For colorless fixers, about 0.007% by weight may be used.

In another embodiment, the fixer without the additive marker (AM) may act as an attenuating filter of the ultraviolet media fluorescence. This fixer will be referred to herein as having ultraviolet media fluorescence (MF). For instance, some fixers used on some print media (e.g., matte-coated, plain white, and others that are extensively used) will act under UV illumination as an attenuating filter of the fluorescence phenomena. Thus, the MF fixer enables a difference in contrast to be measured between the non-inked media and the media having the fixer attached thereto. Thus, in another exemplary embodiment, the image-forming device 12 may be configured with two other pens 34 and 36. One of the pens 34 may apply "normal" fixer and the other pen 36 may apply fixer including the luminescent (i.e., the infrared or ultraviolet) additive marker.

It will be apparent by those of ordinary skill in the art that the fixer with the added fluorescent marker and the fixer having ultraviolet fluorescence (MF) will each have utility in certain implementations. For instance, since the MF fixer is more economical, the MF fixer is more appropriate for certain media that are typically inexpensive and common in the office environment. Even though the fixer including the additive marker may be more expensive, the fixer having the additive marker may be more suitable in certain applications as will become apparent from the following description.

It will be further apparent that the number of fixer compositions, the order of printing the substantially invisible fixer in relation to the visible pigmented ink, and the various colors of pigmented inks used may vary. For instance, the fixer may be applied to the medium first, thus forming an under-print, or the fixer may be applied to the medium last, thus forming an over-print or over-coat, or one or more fixers may be both under-printed and over-printed. In the last instance, the fixer (s) may be the same or different in composition.

With the image-forming system 10 described herein, an encoding pattern may be applied to a print medium using the means for fluorescing or the fixer that is essentially hidden to the naked eye. The encoding pattern may be used in conjunction with an information recording device to calculate a position of an object, such as the information recording device that is used to form an image, in relation to the medium. For instance, the image-forming system 10 may be used to apply a pattern of the means for fluorescing or the fixer in a coordinate system (e.g., a Cartesian coordinate system) to the medium. A sensor of the information recording device may be used to sense the pattern of the fixer and, thus, determine the position of the information recording device in relation to the medium. The fixer may be applied to the medium in any signature pattern used to identify the position on the medium that is essentially invisible to the eye in the visible (e.g., about 400 nm-700 nm, spectral region) yet adsorbent in the infrared or ultraviolet region. By using the fixer to print the encoded pattern, the alternatively-used grayed background that is typically visible from black dot patterns and that detracts from the printed image may be avoided or minimized.

Figure 2:
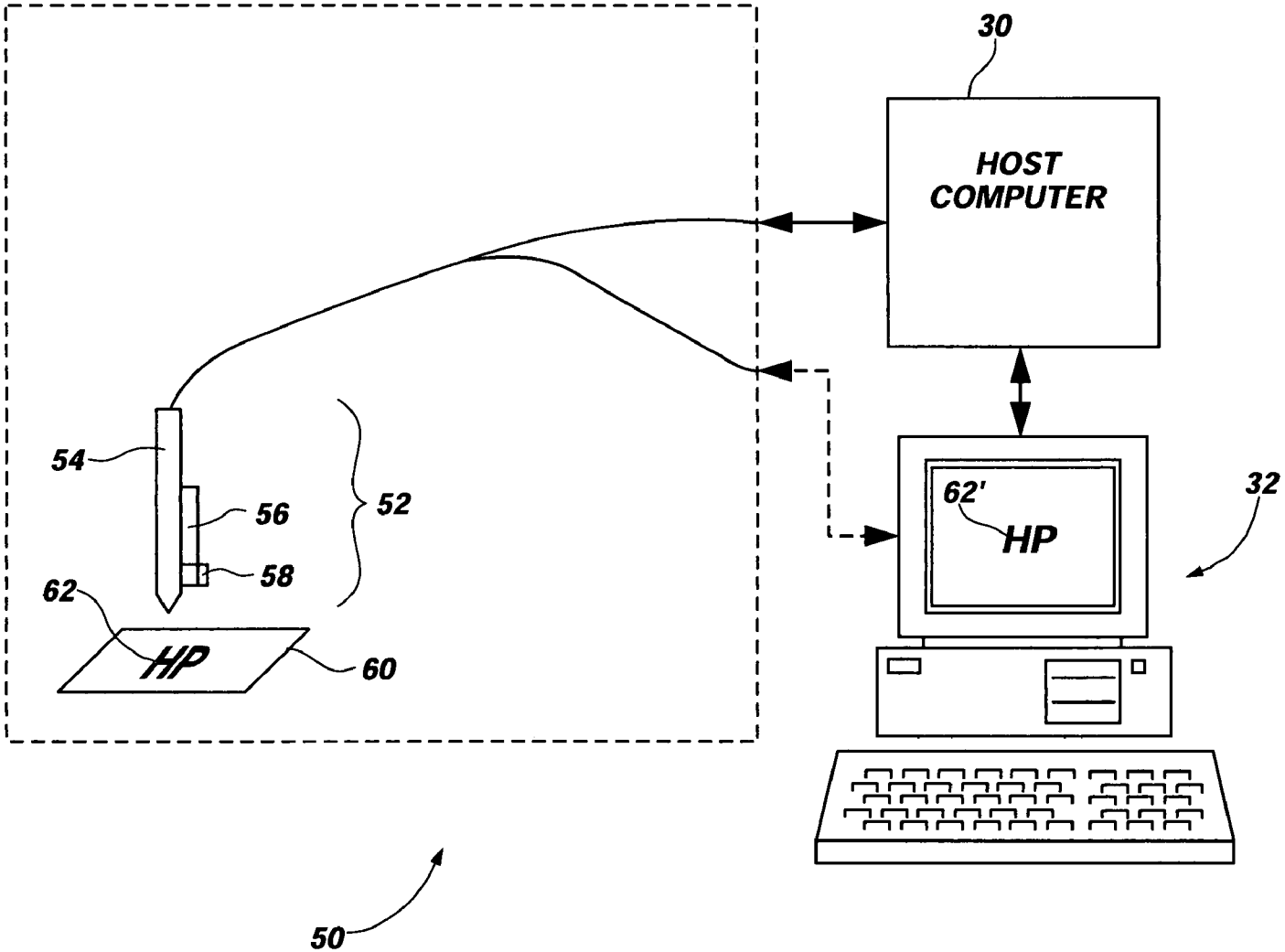
FIG. 2 is a block diagram of one embodiment of an information recording system of the present invention.

Referring now to FIG. 2, there is illustrated one embodiment of an information recording system generally at 50. The information recording system 50 includes a host computer 30 or a personal computer (PC) or terminal 32, such as those from the image-forming system 10 of FIG. 1. The information recording system 10 further includes a recording device illustrated at bracket 52. The recording device 52 includes a writing instrument 54. The writing instrument 54 may be a ball point pen, a fountain pen, a pencil, or any other type of known writing instrument. The recording device 52 further includes a sensor array 56 such as, for example, a digital camera and may also include a source of electromagnetic radiation 58 such as, for example, a light source including an infrared lamp or an ultraviolet light. The information recording system 50 further includes a medium 60 onto which the writing instrument 54 may be used to form indicia 62 thereon. As the writing instrument 54 places the indicia 62 on the medium 60, the sensor array 56 may record the position of the recording device 52 and, thus, electronically track or record the indicia 62 on the terminal 32.

The recording device 52 is operatively connected to the host computer 30, the personal computer (PC), or the terminal 32 such that software of the host computer 30, the PC or the terminal 32 may be used to calculate the position of the recording device 52 in relation to the medium 60. It will be apparent by those of ordinary skill in the art that the components of the recording system 50 may be shared with the components of the image-forming system 10 such that components of both systems 10 and 50 may be used together.

In the exemplary embodiment, the first wavelength is emitted by the source of electromagnetic radiation 58. The source of electromagnetic radiation 58 may comprise light emitting diodes (LEDs) that generate a wavelength of light suitable to cause the means for fluorescing or the fixer to luminesce. It will be apparent by those of ordinary skill in the art that, although not illustrated, refraction and diffusion devices may be combined with the sensor array 56 or the source of electromagnetic radiation 58 in various configurations.

The first wavelength emitted by source of electromagnetic radiation 58 has a bandwidth that corresponds to the source of electromagnetic radiation 58. While an LED may be employed, the source of electromagnetic radiation 58 may also be a tungsten lamp, a filtered metal lamp, or any other suitable lamp.

The source of electromagnetic radiation 58 projects the electromagnetic radiation of the first wavelength range onto the printed pattern applied on the medium 60, and the electromagnetic radiation emitted at the second wavelength range by the fixer of the printed pattern is detected by the sensor array 56. Optical sensor and signal processing techniques are applied and the "sensed" printed pattern is compared to the "actual" printed pattern applied to the medium 60. "Sensed" pattern refers to the pattern detected by the sensor array 56 and "actual" printed pattern refers to the printed pattern applied by the image-forming system 10. In this manner, the location of the recording device 52 or other object may be detected in relation to the printed fixer pattern on the medium 60.

A segmentation process may be used to detect and extract the printing pattern from the medium. The sensor array 56 senses the location of the fixer pattern applied to the medium by detecting a difference in contrast due to the presence or absence of the emittance excited by the first wavelength of electromagnetic radiation. The sensor array 56 also acquires an image of the fixer pattern. Electrical signals corresponding to the emittance are sent to the personal computer (PC) or the terminal 32, wherein the electrical signals are indicative of the positions of the printed pattern on the medium. The acquired image is processed to extract the printed pattern. The sensor array 56 may also include a lens (not shown) and may further include a filter (not shown).

Figure 3A:
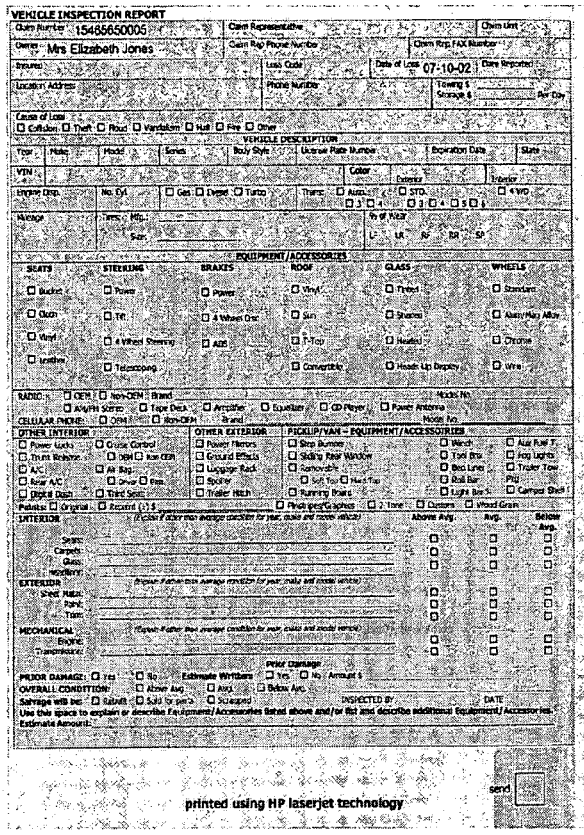
FIGS. 3A-3C illustrate various views of a document produced using a particular embodiment of the image-forming system of the present invention.

In one embodiment, a method of applying an embedded pattern of fixer on a medium using the image-forming system 10 is disclosed. The embedded pattern on the medium is subsequently scanned by the information recording system 50 to ascertain the position of the recording device 52 or other object in relation to the medium 60. FIG. 3A depicts one embodiment of a layout of a document applied to a medium 60' with a HP Laserjet printer, such as the image-forming system 10 of FIG. 1. As illustrated in FIG. 3A, the medium 60' includes text associated with boxes, wherein data or information may be placed in the boxes with the writing instrument 54 of the recording device 52. When a user inputs data or information into the boxes with the writing instrument 54, the sensor array 56 of the recording device 52 is used to sense the invisible, embedded pattern and ascertain the location of the recording device 52 in relation to the medium 60'. In this manner, the recording device 52 is able to electronically store any data or information placed on the medium 60' simultaneously as the user of the writing instrument 54 fills out the form.

Figure 3B:
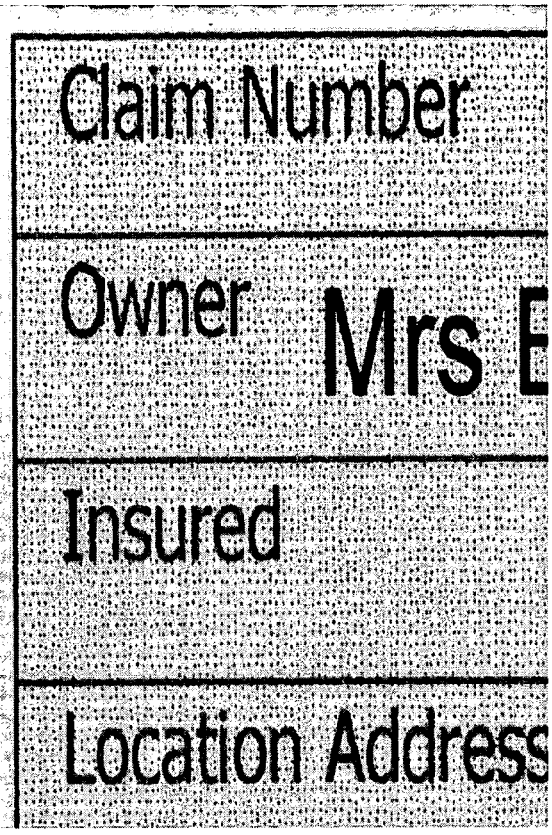
Figure 3C:
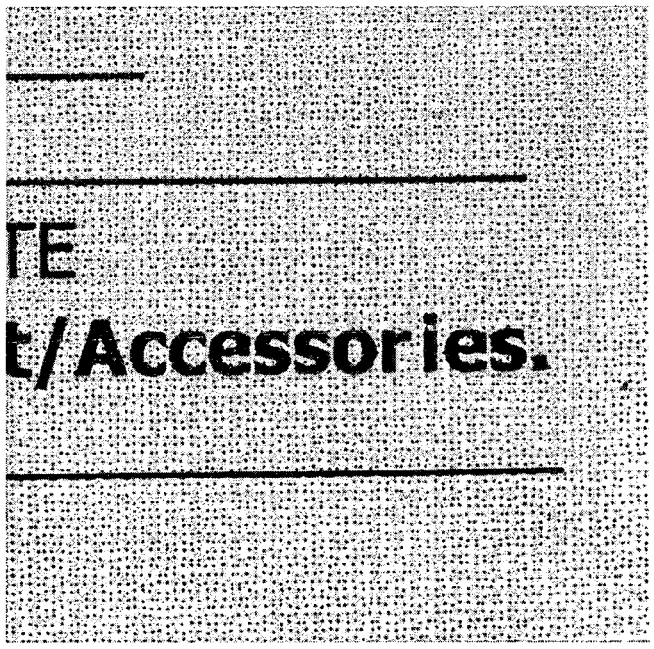

Referring now to FIG. 3B, there is shown an exploded view of a top-left corner of the medium 60' of FIG. 3A. FIG. 3C illustrates an exploded view of a lower-right corner of the medium 60' of FIG. 3A. It will be apparent that the visible patterns of FIG. 3B and FIG. 3C are different and that different parts of the medium 60' are masked by the layout (i.e., the lines and letters) of the medium 60'.

Referring now to FIG. 4, there is illustrated one embodiment of another layout and encoding pattern of a document printed on medium 60" with fixer using the image-forming system 10 of FIG. 1. As illustrated, the document is a medical patient form, but it will be apparent to those of ordinary skill in the art that the document may comprise any known document that may be generated by the image-forming system 10. From viewing the various patterns in FIGS. 3A-4, it will be apparent that there are areas on each of the documents 60' and 60" that do not have any pigmented ink and areas that are impregnated with pigmented ink. Depending on the type of toner used to apply the substantially, invisible pattern, the invisible pattern may or may not be sensed by the sensor array 56. For instance, the fixer (including the luminescent marker upon excitation with the appropriate electromagnetic radiation) will be able to be sensed by the sensor array on all portions of the document, including those covered with pigmented ink.

In contrast, the fixer by itself (that is luminescent (MF) upon proper excitation with the appropriate electromagnetic radiation) is visible where no pigmented ink is present, such as in the boxes without text or lines. Referring now to FIG. 5, there is illustrated a pattern printed on a medium (e.g., Chromolux 700 media) using the luminescent (MF) fixer that is substantially invisible to the naked eye. The pattern of FIG. 5 on the medium is excited with a UV lamp to make the fixer pattern fluoresce and, thus, visible, as illustrated in the image that was taken with a blue channel of an HP 3400C scanner.

Figure 6:
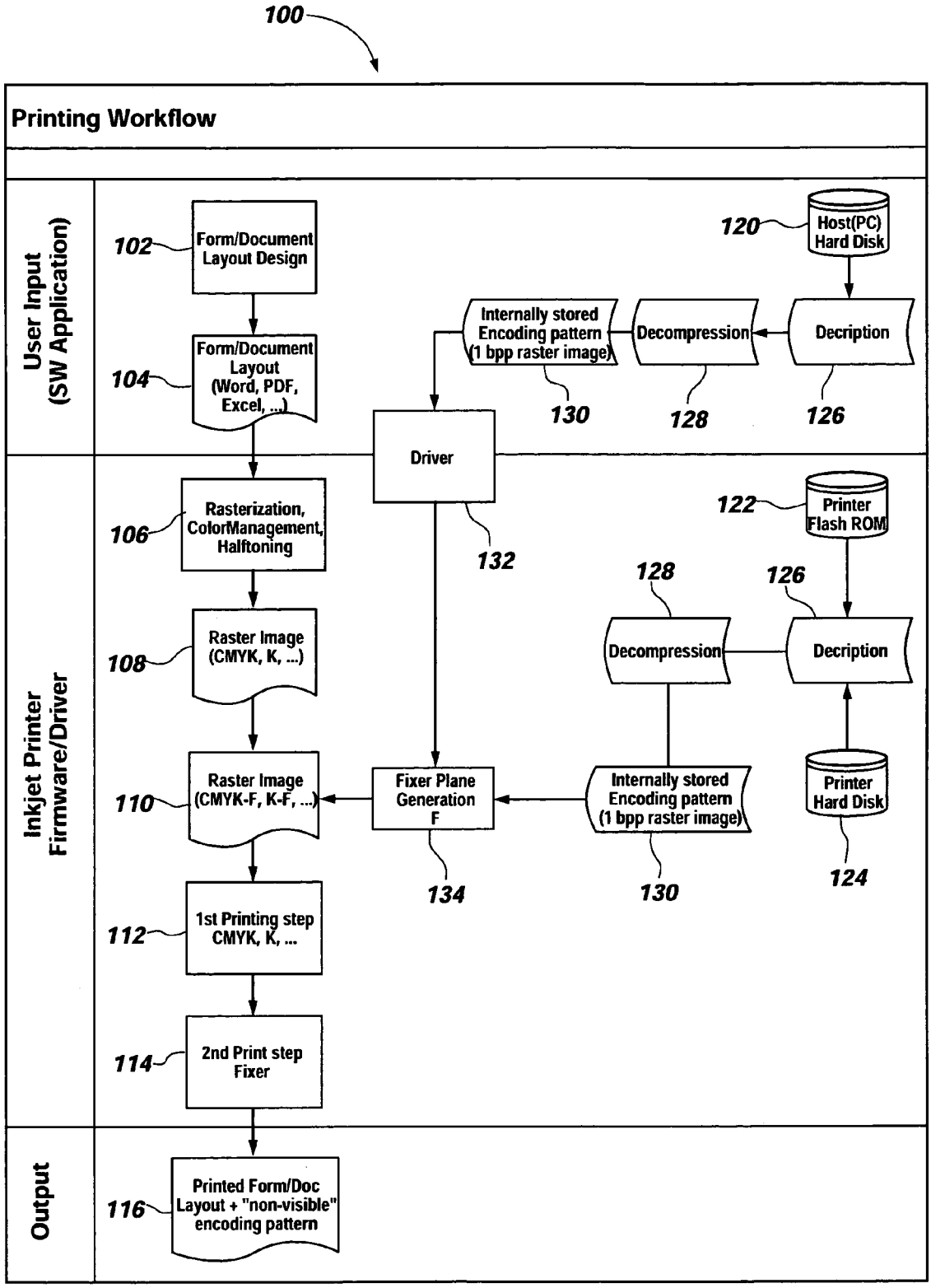
FIG. 6 is a flowchart of one embodiment of a method for forming an encoded pattern with fixer.

Referring now to FIG. 6, there is illustrated a flowchart of one embodiment of a method of applying an encoded, substantially invisible pattern with fixer onto a medium generally at 100. In one embodiment, the image-forming system 10 of FIG. 1 may be used to apply the encoded pattern, wherein the encoded pattern represents a coordinate system such as, for example, a Cartesian coordinate system of the document layout applied to the medium. In the exemplary embodiment, a user supplies a form layout design (e.g., a document at dialog box 102) to the particular software application in use, which includes, for example, Microsoft Word, Microsoft Excel, Adobe PDF, or any other software program that may be used to generate a raster image. The software application may be configured on, for example, the host computer or server 30 of FIG. 1. Depending on the functionality of the image-forming system 10, the method will either follow boxes 102-116 of the flowchart or the method will follow the branched printing methods depicted in boxes 120-134 of the flowchart.

Following the left hand side of the flowchart, the software application prepares an input file for printing at box 104 and converts the input file into a raster image at box 106. The raster image has the correct image-forming color space (CMYK, K, . . . ) assigned by the software application at box 108 and 1-bit plane of fixer (F) data containing the encoding-pattern information is added to the raster image at box 110 by the software. The step of adding the 1-bit plane of fixer (F) may be encrypted and stored in a hard drive of a host during the installation process of the software application. The first image-forming step includes forming the color image or data of the document at box 112 and the second image-forming step includes applying the fixer in the substantially, invisible pattern to the medium at box 114. The form or document including the layout and the "non-visible" encoding pattern is outputted from the process at box 116.

It will be apparent that the image-forming order may be varied when the infrared or ultraviolet additive luminescent marker is added to the fixer. In order to detect the substantially, invisible encoding pattern applied with the fixer including the infrared or ultraviolet additive luminescent marker, the fixer should be applied at box 114 on top of and after the other visible colors (CMYK, K, . . . ) have been applied at box 116. The use of the fluorescent marker added to the fixer allows the encoded-pattern to be detected over inked areas of the document (e.g., photos, drawings, lines, maps, and area fills). If the luminescent (MF) fixer without the added luminescent marker is used, the image-forming orders of box 114 and box 116 may be varied since the fixer pattern is typically only visible in areas where there are no other visible colors.

The use of the essentially invisible fixer pattern allows the user to form the document without having to select any specific colors for the document layout because there is no perceptual interference between the color spaces where the encoding-pattern and document layout lie, thus, providing the user with more flexibility when designing the document. Thus, the user is allowed to generate a document that is perceptually more pleasant and readable. Further, since the fixer plane can be added in the final step of the image-forming process, the encoding pattern will remain intact during the color management workflow of the image-forming device or driver and is, thus, independent of the color management.

In another exemplary embodiment, firmware may prepare the input file for image formation if the image-forming device includes the functionality of an internal storage device, a hard disk, or a flash ROM, as illustrated at boxes 120, 122 or 124. In these embodiments, the functional image-forming device is able to decrypt the 1-bit plane image of the encoding pattern at box 126 and decompress the 1-bit plane image of the encoding pattern at box 128. The internally stored encoding pattern is converted to a raster image at box 130 and, if the image is processed by the host (PC) hard disk at box 120, a driver is used to convert the image at box 132. At box 134, the 1-bit plane of fixer data containing the encoding-pattern information is added to the image. The image-forming process proceeds as previously described herein at box 110.

Use of the firmware to prepare the input file for printing provides the manufacturer of the print medium or the information recording device with security protection of the intellectual property value of the document. For instance, the merging of the substantially invisible, encoding-pattern with the document layout occurs within the printer-box (firmware) and enforces a safer security layer. Further, since the encoded-pattern is detected with the sensor array 56 in combination with the appropriate illumination of the recording device 52, the document produced using the methods described herein is most compatible with the recording device 52 of the present invention. Thus, other recording devices, such as those utilizing other technology, may not function in combination with the document produced with the encoded-pattern of the present invention. Also, the encoded-pattern applied with fixer makes it difficult to produce multiple copies of the encoding-pattern on the original document and mandates that original documents be produced each time instead of producing copies having the encoded pattern.

Once the form or document has been formed by the image-forming system 10, the information recording system 50 may be used to detect the fixer pattern and calculate a position of the recording device 52 or other object in relation to the medium with a segmentation process. As the user inputs data onto the form with the writing instrument 54 of the recording device 52, the sensor array 56 decodes the, encoded pattern illuminated by the source of electromagnetic radiation 58 and, thus, enables the position of the recording device 52 to be determined in relation to the encoded pattern of the medium. If the fixer includes the infrared additive marker to form the fixer pattern, the source of electromagnetic radiation 58 will comprise an infrared lamp. When the fixer includes the ultraviolet additive marker or is the MF fixer that is fluorescent, the source of electromagnetic radiation will comprise an ultraviolet lamp such as, for example, a Lamp Stanley Cold Cathode Fluorescent Lamp (product number KTCE40KPTD-300UV2).

The difference in contrast between the fixer on the media and a non-fixer inked media depends on four factors: the light source used to illuminate the fixer, the sensor array used to detect the fixer, the medium onto which the fixer is printed, and the fixer technique used. Simple experimentation will enable one of ordinary skill in the art to determine the appropriate combination of the four factors in order to adequately detect the fixer on the media. For instance, an appropriate combination of the fixer and the light source will provide enough contrast such that the pattern of fixer may be extracted from the medium with the sensor array.

Although the present invention has been shown and described with respect to various exemplary embodiments, various additions, deletions and modifications that are obvious to a person of ordinary skill in the art to which the invention pertains, even if not shown or specifically described herein, are deemed to lie within the scope of the invention as encompassed by the following claims.

What is claimed is:

1. A method for printing a pattern on a medium, the method comprising:

assigning a pattern to a medium, wherein the pattern defines coordinates of a portion of the medium;

applying a fixer to the portion of the medium in the pattern, wherein the fixer includes an infrared marker or an ultraviolet marker;

applying an ink to a different portion of the medium.

2. The method according to claim 1 further comprising:

designing a layout of a document;

preparing an image of the layout of the document for printing; and applying ink to the medium to form the image.

3. The method according to claim 2, wherein the step of applying the fixer to the medium is done before applying the ink to the medium.

4. The method according to claim 2, wherein the step of applying the ink to the medium is done before applying the fixer to the medium.

5. The method according to claim 2, further comprising;

assigning a 1-bit plane of data to the image, wherein the 1-bit plane of data corresponds to the pattern.

6. The method according to claim 2, wherein preparing the image of the layout of the document for printing comprises configuring software associated with a computer to prepare the image of the layout of the document for printing.

7. The method according to claim 2, wherein preparing the image of the layout of the document for printing comprises configuring firmware to prepare the image of the layout of the document for printing.

8. A method for printing a pattern on a medium, the method comprising:

assigning a pattern to a medium, wherein the pattern defines coordinates of a portion of the medium;

applying a fixer to the portion of the medium in the pattern; and applying an ink to a different portion of the medium, wherein the fixer is capable of fluorescing or acting as an attenuating filter of fluorescence when exposed to a predetermined wavelength of electromagnetic radiation.

9. The method according to claim 8, further comprising:

designing a layout of a document;

preparing an image of the layout of the document for printing; and applying ink to the medium to form the image.

10. The method according to claim 9, wherein the step of applying the fixer to the medium is done before applying the ink to the medium.

11. The method according to claim 9, wherein the step of applying the ink to the medium is done before applying the fixer to the medium.

12. The method according to claim 9, further comprising:

assigning a 1-bit plane of data to the image, wherein the 1-bit plane of data corresponds to the pattern.

13. The method according to claim 9, wherein preparing the image of the layout of the document for printing comprises configuring software associated with a computer to prepare the image of the layout of the document for printing.

14. The method according to claim 9, wherein preparing the image of the layout of the document for printing comprises configuring firmware to prepare the image of the layout of the document for printing.

15. A method for calculating a position of an object in relation to a medium, the method comprising:

applying a coordinate pattern to a medium, wherein the coordinate pattern comprises a fixer capable of fluorescing when subjected to a predetermined wavelength of electromagnetic radiation;

projecting the predetermined wavelength onto the pattern;

detecting a presence or an absence of emittance from the fixer in the coordinate pattern on the medium excited by the wavelength; and responsive to the presence or the absence of the emittance, calculating a position of the object in relation to the medium.

16. The method according to claim 15, wherein calculating the position of the object in relation to the medium comprises calculating a position of a writing instrument in relation to the medium.

17. The method according to claim 15, further comprising:

designing a layout of a document;

preparing an image of the document for printing; and applying ink to the medium to form the image.

18. The method according to claim 15, wherein projecting the predetermined wavelength of electromagnetic radiation onto the pattern comprises directing an ultraviolet or an infrared wavelength onto the pattern.

19. The method according to claim 15, wherein detecting the presence or the absence of the emittance from the fixer in the coordinate pattern comprises positioning a sensor in relation to the coordinate pattern such that the sensor collects the presence or the absence of the emittance from the coordinate pattern.

20. The method according to claim 15, further comprising:

writing on the medium with a writing instrument; and electronically storing the position of the writing instrument in relation to the medium.

21. The method according to claim 15, wherein writing on the medium and electronically storing the position occur substantially simultaneously.

* * * * *

UNITED STATES PATENT AND TRADEMARK OFFICE

CERTIFICATE OF CORRECTION

PATENT NO. : 7,517,041 B2
APPLICATION NO. : 10/717953
DATED : April 14, 2009
INVENTOR(S) : Palmer et al.

It is certified that error appears in the above-identified patent and that said Letters Patent is hereby corrected as shown below:

In column 10, line 10, in Claim 5, delete "comprising;" and insert -- comprising: --, therefor.

Signed and Sealed this

Third Day of November, 2009

David J. Kappos

David J. Kappos
*Director of the United States Patent and Trademark Office*